US007011383B2

(12) United States Patent
Edwards et al.

(10) Patent No.: US 7,011,383 B2
(45) Date of Patent: Mar. 14, 2006

(54) METHOD FOR BORDERLESS PRINTING USING A PRINTER ADAPTED TO PRINT DOTS

(75) Inventors: Mark J. Edwards, Lexington, KY (US); Ricky E. Robbins, Daville, KY (US)

(73) Assignee: Lexmark International, Inc., Lexington, KY (US)

( * ) Notice: Subject to any disclaimer, the term of this patent is extended or adjusted under 35 U.S.C. 154(b) by 258 days.

(21) Appl. No.: 10/753,996

(22) Filed: Jan. 8, 2004

(65) Prior Publication Data

US 2005/0151775 A1 Jul. 14, 2005

(51) Int. Cl.
*B41J 2/145* (2006.01)

(52) U.S. Cl. ..... 347/16; 347/41

(58) Field of Classification Search ..... 347/41, 347/16, 13, 42, 10

See application file for complete search history.

(56) References Cited

U.S. PATENT DOCUMENTS 4,719,473 A 1/1988 Shimamura
5,432,533 A 7/1995 Shibamiya
5,568,169 A * 10/1996 Dudek et al. ..... 347/43
5,825,996 A 10/1998 Davis et al.
5,881,210 A 3/1999 Guay et al.
5,982,998 A 11/1999 Takahashi et al.
5,997,129 A 12/1999 Matsuhashi
6,137,515 A 10/2000 Dickinson
6,173,649 B1 1/2001 Onishi
6,239,817 B1 5/2001 Meyer
6,250,734 B1 * 6/2001 Otsuki ..... 347/16
6,409,305 B1 6/2002 Elgee et al.
6,411,324 B1 6/2002 Christiansen et al.
6,414,755 B1 7/2002 Bronstein et al.
6,469,806 B1 10/2002 Richenderfer et al.
6,494,571 B1 12/2002 Finkel
6,530,633 B1 3/2003 Morozumi et al.
6,557,973 B1 5/2003 Elgee
2002/0036664 A1 3/2002 Arima et al.

* cited by examiner

*Primary Examiner*—Lamson Nguyen
(74) *Attorney, Agent, or Firm*—Douglas E. Erickson

(57) ABSTRACT

Method for printing an image on a print medium having an edge or an edge portion. A printer adapted to print the image by printing dots is obtained. Dots are printed beyond a preselected distance from the edge or edge portion at a first percent of print dot density. Dots are printed at and within the preselected distance from the edge or edge portion at a varying percent of print dot density, wherein the varying percent steps down and not up at least two times as the distance from the edge or edge portion of dots to be printed decreases. In one example, the printer is an inkjet printer.

22 Claims, 1 Drawing Sheet

METHOD FOR BORDERLESS PRINTING USING A PRINTER ADAPTED TO PRINT DOTS

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates generally to printing, and more particularly to a method for borderless printing using a printer adapted to print dots.

2. Description of the Related Art

Printers include, without limitation, computer printers, copiers, facsimile machines, and multifunction printers which also scan, copy, fax, etc. Some printers, such as inkjet printers, print by printing closely-spaced ink dots on a print medium such as paper. Conventional inkjet printers include those having a carrier with at least one printhead such as a color printhead, a mono printhead, or a photo printhead. Some inkjet printers are controlled by software in a host (e.g., user's) computer, such software including a printing application (such as a word processor or a spreadsheet) for creating a print job and including a printer driver for printing the print job with a particular make and model of printer.

Conventional inkjet printers have a normal printing mode (or modes) which leave a predetermined minimum unprintable top, bottom, left and right margin on the paper sheet. This allows faster printing and avoids overspray of ink at the edges of the sheet. However, portions of the image extending beyond such unprintable margins are not printed in the normal printing mode(s). Some conventional inkjet printers also have a borderless printing mode (or modes) which leaves no unprintable margins from two perpendicular edges or from all four edges of the sheet. In one known borderless printing method, the image is printed at one-hundred percent print swath density over the entire sheet including at the edges. In another known borderless printing method, a checkered pattern for printing is used which reduces the print swath density by fifty percent when printing near an edge of the sheet. In an additional known borderless printing method, a predetermined pattern of print data bits are set to not print for at least one column of dots to be printed adjacent a lateral edge of the sheet. In a further known borderless printing method where two-pass printing is used in a normal printing mode, one pass printing is used adjacent an edge of the sheet and two-pass printing is used elsewhere. The last three known borderless printing methods reduce print overspray at the edge of the sheet which reduces ink buildup in the gutters of the inkjet printer, wherein the gutters are provided for catching the print overspray.

What is needed is an improved method for borderless printing using a printer, such as an inkjet printer, adapted to print dots.

SUMMARY OF THE INVENTION

A broad method of the invention is for printing an image on a print medium having an edge and includes steps a) through d). Step a) includes obtaining an inkjet printer having a printhead which is movable along a print swath axis and which includes inkjet nozzles arranged to print the image by printing columns of dots as the printhead moves along the print swath axis, wherein each column of dots is substantially perpendicular to the print swath axis. The column of dots may contain one or more dots that are actually printed. Step b) includes positioning the print medium with the edge substantially perpendicular or parallel to the print swath axis. Step c) includes using the printhead to print on the print medium, beyond a preselected distance from the edge, columns of dots representing a portion of the image at a first percent of print swath density. Step d) includes using the printhead to print on the print medium, at and within the preselected distance from the edge, columns of dots representing a portion of the image at a varying percent of print swath density, wherein the varying percent is the first percent at the preselected distance from the edge, and wherein the varying percent steps down and not up at least two times as the distance from the edge to the dots to be printed decreases.

In a first detailed method, in step d) the varying percent steps down by turning off or on more of the address lines in the printhead. In a second detailed method, in step d) the varying percent steps down or up by ramping down or up, respectively the voltage to the printhead. In a third detailed method, in step d) the varying percent steps down or up by reducing or increasing, respectively, the printhead power line pulse widths.

An additional broad method of the invention is for printing an image on a substantially-circular-shaped print medium having an edge and includes steps a) through f). Step a) includes obtaining an inkjet printer having a printhead movable along a print swath axis and including a plurality of nozzles arranged to print the image by printing columns of dots as the printhead moves along the print swath axis creating a print swath, wherein each column of dots is substantially perpendicular to the print swath axis. Step b) includes positioning the circular medium such that the print swath axis is substantially aligned with a diameter of the print medium. Step c) includes choosing a print swath height of printable nozzles such that an edge portion which is in line with the print swath is substantially perpendicular to the print swath axis. Step d) includes using the printhead to print on the print medium, beyond a preselected distance from the edge portion, columns of dots at the print swath height representing a portion of the image at a first percent of print swath density. Step e) includes using the printhead to print on the print medium, at and within the preselected distance from the edge portion, columns of dots at the print swath height representing a portion of the image at a varying percent of print swath density, wherein the varying percent is the first percent at the preselected distance from the edge portion, and wherein the varying percent steps down and not up a plurality of times as the distance from the edge portion of dots to be printed decreases. Step f) includes, after steps a) through e), rotating the circular print medium about it's center a predetermined amount.

A further broad method of the invention is for printing an image on a print medium having an edge and includes steps a) through d). Step a) includes obtaining an inkjet printer having a page-wide printhead including a plurality of nozzles arranged to print the image by printing rows of dots as the print medium relatively moves with respect to the printhead along a print swath axis, wherein each row of dots is substantially perpendicular to the print swath axis. Step b) includes positioning the print medium with the edge substantially perpendicular or parallel to the print swath axis. Step c) includes using the printhead to print on the print medium, beyond a preselected distance from the edge, rows of dots representing a portion of the image at a first percent of print swath density. Step d) includes using the printhead to print on the print medium, at and within the preselected distance from the edge, rows of dots representing a portion of the image at a varying percent of print swath density, wherein the varying percent is the first percent at the preselected distance from the edge, wherein the varying percent steps down and not up a plurality of times as the distance from the edge to the dots to be printed decreases.

An overall method of the invention is for printing an image on a print medium having an edge or an edge portion and includes steps a) through c). Step a) includes obtaining a printer adapted to print the image by printing dots. Step b) includes using the printer to print on the print medium, beyond a preselected distance from the edge or edge portion, dots representing a portion of the image at a first percent of print dot density. Step c) includes using the printer to print on the print medium, at and within the preselected distance from the edge or edge portion, dots representing a portion of the image at a varying percent of print swath density, wherein the varying percent is the first percent at the preselected distance from the edge or edge portion, and wherein the varying percent steps down and not up a plurality of times as the distance from the edge or edge portion to the dots to be printed decreases.

Several benefits and advantages are derived from one or more of the methods of the invention. By stepping down the print swath density at least two times as the dots to be printed approach the edge of the print medium allows for borderless printing to that edge in a gradual manner resulting in a more pleasing printed image. By having the varying percent step down by turning off or on more of the address lines in the printhead, by ramping down or up the voltage to the printhead, or by reducing or increasing the printhead power line pulse widths avoids using a masking pattern (requiring special software swath formatting) to achieve a reduced print swath density at the edge to reduce print overspray and gutter ink buildup.

DETAILED DESCRIPTION

Figure 1:
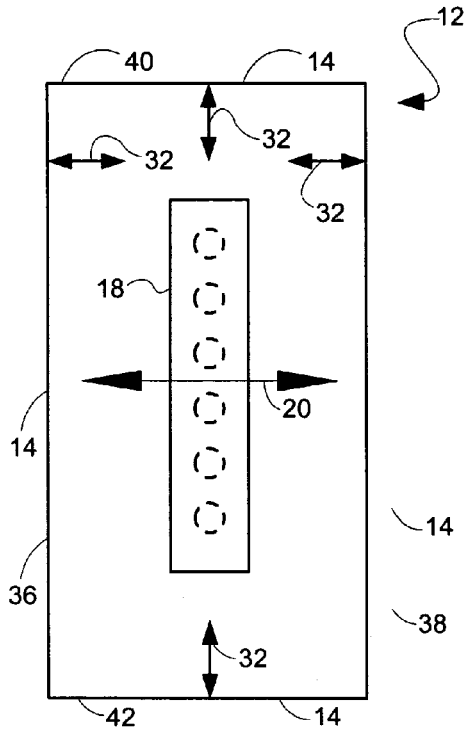
FIG. 1 is a schematic top plan view of a printhead of an inkjet printer positioned over a print medium for printing an image on the print medium.
Figure 2:
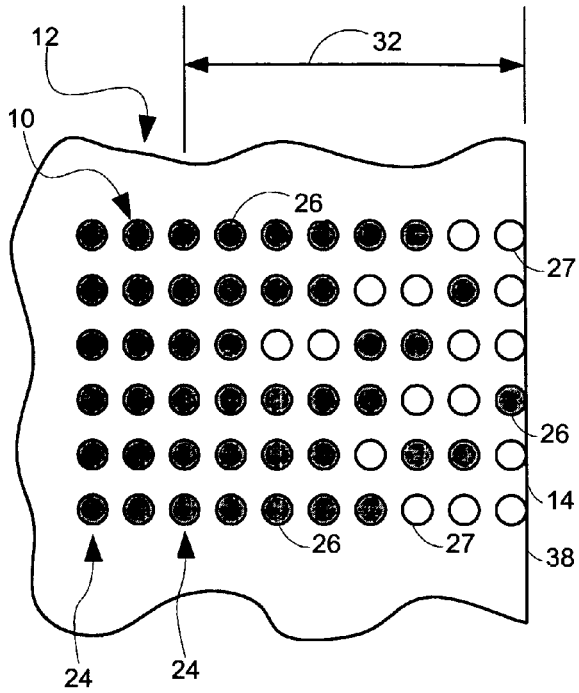
FIG. 2 is an enlarged view of an area adjacent the right-side of the print medium of FIG. 1 after the printhead of FIG. 1 has printed a part of the image on the print medium illustrating the decrease in the print swath density as the distance from the edge to the dots to be printed decreases.
Figure 3:
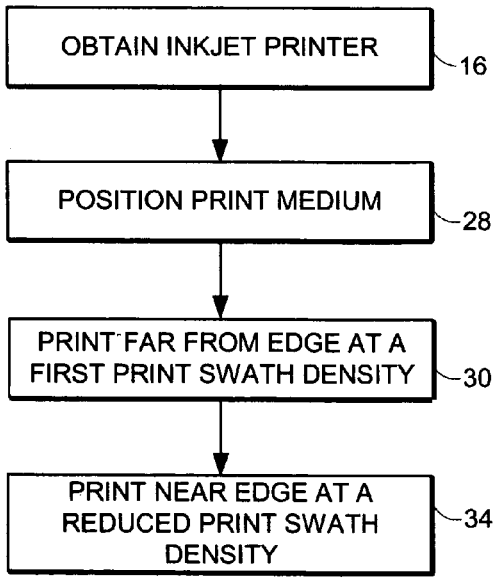
FIG. 3 is a block diagram of a broad method of the invention for printing an image on a print medium which, in one application, is carried out using the printhead of FIG. 1.

Referring to FIGS. 1–3, a broad method of the invention is for printing an image 10 on a print medium 12 having an edge 14 and includes steps a) through d). Step a) is labeled as "Obtain Inkjet Printer" in block 16 of FIG. 3. Step a) includes obtaining an inkjet printer having a printhead 18 movable along a print swath axis 20 and including a plurality of inkjet nozzles 22 (shown as dash-line circles because the nozzles are otherwise hidden in the top view of the printhead in FIG. 1) arranged to print the image 10 by printing columns 24 of dots 26 as the printhead 18 moves along the print swath axis 20, wherein each column 24 of dots 26 is substantially perpendicular to the print swath axis 20. Step b) is labeled as "Position Print Medium" in block 28 of FIG. 3. Step b) includes disposing the print medium 12 with the edge 14 substantially perpendicular or parallel to the print swath axis 20. Step c) is labeled as "Print Far From Edge At A First Print Swath Density" in block 30 of FIG. 3. Step c) includes using the printhead 18 to print on the print medium 12, beyond a preselected distance 32 from the edge 14, columns 24 of dots 26 representing a portion of the image 10 at a first percent of print swath density. Step d) is labeled as "Print Near Edge At Reduced Print Swath Density" in block 34 of FIG. 3. Step d) includes using the printhead 18 to print on the print medium 12, at and within the preselected distance 32 from the edge 14, columns 24 of dots 26 representing a portion of the image 10 at a varying percent of print swath density, wherein the varying percent is the first percent at the preselected distance 32 from the edge 14, and wherein the varying percent steps down and not up a plurality of times as the distance from the edge 14 to the dots 26 to be printed decreases.

In one enablement of the broad invention, the first percent is substantially one-hundred percent. Printing at one-hundred percent of print swath density of the printhead means enabling all of the inkjet nozzles to print a dot (sometimes referred to as a pixel) at each print opportunity. Whether a particular nozzle actually prints a dot at a particular print opportunity depends on whether the print job for the image calls for a printed dot or a non-printed dot (i.e., a "white" space) from the particular nozzle at a particular location on the print medium corresponding to the particular print opportunity. Printing at less than one-hundred percent of print swath density means that at least one particular inkjet nozzle is non-enabled (i.e., prevented from firing or ejecting an ink drop) for at least one particular print opportunity even if the print job for the image is calling for a printed dot from that nozzle at that print opportunity for a particular location on the print medium. By way of illustration, assume that the print job example of FIG. 2 calls for printing dots 26 with all inkjet nozzles 22 at each print opportunity, wherein a dot 26 (shown as a darkened circle in FIG. 2) represents a printed dot, and wherein a non-darkened circle 27 represents an unprinted dot desired to be printed by the print job whose printing is prevented by the broad method of the invention. The four left-most columns 24 of dots 26 are printed at one-hundred percent of print swath density and the six right-most columns of dots (including the right-most column which has only one printed dot in the column) are printed at less than one-hundred percent of print swath density. If the print job example did not call for printing with all inkjet nozzles 22 at each print opportunity, then a darkened dot in FIG. 2 would represent a drop location on the print medium for which a nozzle was enabled (and printed only if called for by the print job) and a non-darkened circle in FIG. 2 would represent a drop location on the print medium for which a nozzle was non-enabled by the broad method of the invention (and not printed even if printing of that dot was called for by the print job). Other percent step-downs, in addition to the one shown in FIG. 2, may be used and are left to the artisan. The column of dots and the dots within each column shown in FIG. 2 are shown spaced apart for purposes of illustration. In practice the spacing between columns of dots as well as between the dots in the column may be varied, including having overlapping columns and or overlapping dots within a column.

The broad method is independent of the number of nozzles, the particular arrangement of the nozzles, the firing delay of a slanted column or offset columns of nozzles, etc. (or even if the printer has additional printheads active during a print swath), but merely requires that the inkjet printer print columns 24 of dots 26 as the printhead 18 moves along the print swath axis 20, wherein each column 24 of dots 26 is substantially perpendicular to the print swath axis 20. It is noted that a print opportunity for a particular nozzle depends on the speed of the moving printhead, whether or not the particular print swath is a shingling print swath, etc.

In one example of the broad method of the invention, the varying percent is between and including zero percent and fifteen percent at the edge 14. In one variation, the varying percent is substantially five percent at the edge 14. In the same or a different example, the preselected distance is between and including about 0.039 inch and about 0.125 inch.

Although the printhead 18 of FIG. 1 is shown with only six inkjet nozzles 22, it is understood that a typical printhead has many more nozzles, and in one embodiment has one hundred fifty nozzles producing a half-inch-high full-printhead-height print swath having a vertical print resolution of three hundred dots per inch. In one employment of the broad method, the varying percent steps down at least ten times as the distance from the edge 14 to the dots 26 to be printed decreases. In one variation, the varying percent steps down in equal percent decrements and/or at equal distance increments as the distance from the edge 14 to the dots 26 to be printed decreases. Other variations may be used and are left to the artisan.

In one application of the broad method, the edge 14 is a left or right edge 36 or 38. In one variation, the preselected distance 32 for a left edge 36 is substantially equal to the preselected distance 32 for a right edge 38. In another variation, such preselected distances are not equal. It is noted that for a printhead 18 printing from left to right while approaching the right edge 38 (which would be a trailing edge), the varying percent steps down a plurality of times as the distance from the right edge 38 to the dots 26 to be printed decreases. For a printhead 18 printing from left to right while moving away from the left edge 36 (which would be a leading edge), the varying percent also steps down a plurality of times as the distance from the left edge 36 to the dots 26 to be printed decreases (which is equivalent, to saying that the varying percent steps up a plurality of times as the distance from the left edge 36 to the dots 26 to be printed increases). For a printhead 18 printing from right to left while approaching the left edge 36 (which would be a trailing edge), the varying percent steps down a plurality of times as the distance from the left edge 36 to the dots 26 to be printed decreases. For a printhead 18 printing from right to left while moving away from the right edge 38 (which would be a leading edge), the varying percent also steps down a plurality of times as the distance from the right edge 36 to the dots 26 to be printed decreases (which is equivalent, to saying that the varying percent steps up a plurality of times as the distance from the right edge 38 to the dots 26 to be printed increases).

In another application of the broad method, the edge 14 is a top or bottom edge 40 or 42. In a further application, the broad method is applied to at least two of the left, right, top and bottom edges 36, 38, 40 and 42. In one variation, the applied-to edges are substantially perpendicular to each other. In another variation, the applied-to edges are all four of the left, right, top and bottom edges 36, 38, 40 and 42. In one construction, step d) includes applying at least one special swath-formatting mask to the print job data wherein the at-least-one mask includes at least two step downs of print swath density.

A first more-detailed method of the invention is for printing an image 10 on a print medium 12 having an edge 14 and includes steps a) through d). Step a) includes obtaining an inkjet printer having a printhead 18 movable along a print swath axis 20 and including a plurality of inkjet nozzles 22 arranged to print the image 10 by printing columns 24 of dots 26 as the printhead 18 moves along the print swath axis 20, wherein each column 24 of dots 26 is substantially perpendicular to the print swath axis 20. Step b) includes disposing the print medium 12 with the edge 14 substantially perpendicular or parallel to the print swath axis 20. Step c) includes using the printhead 18 to print on the print medium 12, beyond a preselected distance 32 from the edge 14, columns 24 of dots 26 representing a portion of the image 10 at a first percent of print swath density. Step d) includes using the printhead 18 to print on the print medium 12, at and within the preselected distance 32 from the edge 14, columns 24 of dots 26 representing a portion of the image 10 at a varying percent of print swath density, wherein the varying percent is the first percent at the preselected distance 32 from the edge 14, wherein the varying percent steps down and not up a plurality of times as the distance from the edge 14 to the dots 26 to be printed decreases, and wherein the varying percent steps down by turning off or on more of the address lines (not shown in the FIG. 1) in the printhead 10. The operation of printhead address lines in inkjet printers is well known.

In one employment of the first more-detailed method, step d) employs a printer ASIC (application-specific-integrated-circuit)/firmware combination to automatically perform the percent step downs near the edge 14.

In one application of the first more-detailed method, the edge 14 is a left or right edge 36 or 38, wherein the edge 36 or 38 is substantially perpendicular to the print swath axis 20, wherein the printhead 18 moves from the preselected distance 32 from the edge to the edge 36 or 38 during step d), and wherein the varying percent steps down by turning off more of the address lines in the printhead 18. In another application, the edge is a left or right edge 36 or 38, wherein the edge 36 or 38 is substantially perpendicular to the print swath axis 20, wherein the printhead 18 moves from the edge 36 or 38 to the preselected distance 32 from the edge during step d), and wherein the varying percent steps up by turning on more of the address lines in the printhead 18.

In an additional application of the first more-detailed method, the edge 14 is a top or bottom edge 40 or 42, wherein the edge 40 or 42 is substantially parallel to the print swath axis 20, wherein the printhead 18, between print swaths during step d), relatively moves with respect to the print medium 12 in a direction substantially perpendicular to the print swath axis 20 from the edge 40 or 42 to the preselected distance 32 from the edge, and wherein step d) includes multiple print passes of sub-printhead-height print swaths with the varying percent stepping up by turning on more of the address lines in the printhead 18 with increasing distance from the edge 40 or 42. By "relatively moves" means the print medium 12 moves in a direction substantially perpendicular to the print swath axis 20 and the printhead 18 does not move in the direction substantially perpendicular to the print swath axis 20, or the print medium 12 does not move in a direction substantially perpendicular to the print swath axis 20 and the printhead 18 moves in the direction substantially perpendicular to the print swath axis 20, or both the print medium 12 and the printhead 18 so move producing relative motion. In a further application, the edge 14 is a top or bottom edge 40 or 42, wherein the edge 40 or 42 is substantially parallel to the print swath axis 20, wherein the printhead 18, between print swaths during step d), relatively moves with respect to the print medium 12 in a direction substantially perpendicular to the print swath axis 20 from the preselected distance 32 from the edge to the edge 40 or 42, and wherein step d) includes multiple print passes of sub-printhead-height print swaths with the varying percent stepping down by turning off more of the address lines in the printhead 18 with decreasing distance from the edge 40 or 42.

A second more-detailed method of the invention is for printing an image 10 on a print medium 12 having an edge 14 and includes steps a) through d). Step a) includes obtaining an inkjet printer having a printhead 18 movable along a print swath axis 20 and including a plurality of inkjet nozzles 22 arranged to print the image 10 by printing columns 24 of dots 26 as the printhead 18 moves along the print swath axis 20, wherein each column 24 of dots 26 is substantially perpendicular to the print swath axis 20. Step b) includes disposing the print medium 12 with the edge 14 substantially perpendicular or parallel to the print swath axis 20. Step c) includes using the printhead 18 to print on the print medium 12, beyond a preselected distance 32 from the edge 14, columns 24 of dots 26 representing a portion of the image 10 at a first percent of print swath density. Step d) includes using the printhead 18 to print on the print medium 12, at and within the preselected distance 32 from the edge 14, columns 24 of dots 26 representing a portion of the image 10 at a varying percent of print swath density, wherein the varying percent is the first percent at the preselected distance 32 from the edge 14, wherein the varying percent steps down and not up a plurality of times as the distance from the edge 14 to the dots 26 to be printed decreases, and wherein the varying percent steps down by ramping down the voltage to the printhead 18. Providing a printhead voltage to the printhead of inkjet printers is well known.

In one application of the second more-detailed method, the edge 14 is a left or right edge 36 or 38. In another application, the edge 14 is a top or bottom edge 40 or 42, wherein the voltage is stepwise controlled, and wherein step d) includes multiple print passes of sub-printhead-height print swaths.

A third more-detailed method of the invention is for printing an image 10 on a print medium 12 having an edge 14 and includes steps a) through d). Step a) includes obtaining an inkjet printer having a printhead 18 movable along a print swath axis 20 and including a plurality of inkjet nozzles 22 arranged to print the image 10 by printing columns 24 of dots 26 as the printhead 18 moves along the print swath axis 20, wherein each column 24 of dots 26 is substantially perpendicular to the print swath axis 20. Step b) includes disposing the print medium 12 with the edge 14 substantially perpendicular or parallel to the print swath axis 20. Step c) includes using the printhead 18 to print on the print medium 12, beyond a preselected distance 32 from the edge 14, columns 24 of dots 26 representing a portion of the image 10 at a first percent of print swath density. Step d) includes using the printhead 18 to print on the print medium 12, at and within the preselected distance 32 from the edge 14, columns 24 of dots 26 representing a portion of the image 10 at a varying percent of print swath density, wherein the varying percent is the first percent at the preselected distance 32 from the edge 14, wherein the varying percent steps down and not up a plurality of times as the distance from the edge 14 to the dots 26 to be printed decreases, and wherein the varying percent steps down by reducing the printhead power line pulse widths. Providing printhead power line pulses for the printhead of inkjet printers is well known.

In one application of the third more-detailed method, the edge 14 is a left or right edge 36 or 38. In another application, the edge 14 is a top or bottom edge 40 or 42, wherein step d) includes multiple print passes of sub-printhead-height print swaths.

It is noted that any of the previously-described broad, first more-detailed, second more-detailed, and third more-detailed methods of the invention can be employed for borderless printing to any one or more of the left, right, top and bottom edges 36–42 of the print medium 12, as can be appreciated by the artisan.

An additional broad method of the invention is for printing an image on a substantially-circular-shaped print medium having an edge and includes steps a) through f). Step a) includes obtaining an inkjet printer having a printhead movable along a print swath axis and including a plurality of nozzles disposed to print the image by printing columns of dots as the printhead moves along the print swath axis creating a print swath, wherein each column of dots is substantially perpendicular to the print swath axis. Step b) includes disposing the circular medium such that the print swath axis is substantially aligned with a diameter of the print medium. Step c) includes choosing a print swath height of printable nozzles such that an edge portion which is in line with the print swath is substantially perpendicular to the print swath axis. Step d) includes using the printhead to print on the print medium, beyond a preselected distance from the edge portion, columns of dots at the print swath height representing a portion of the image at a first percent of print swath density. Step e) includes using the printhead to print on the print medium, at and within the preselected distance from the edge portion, columns of dots at the print swath height representing a portion of the image at a varying percent of print swath density, wherein the varying percent is the first percent at the preselected distance from the edge portion, and wherein the varying percent steps down and not up a plurality of times as the distance from the edge portion to the dots to be printed decreases. Step f) includes, after steps a) through e), rotating the circular print medium about it's center a predetermined amount. In one example of the additional broad method, steps d) through f) are repeated until the printing has been completed on the substantially-circular-shaped print medium. In one variation, the print medium is a CD or DVD.

A further broad method of the invention is for printing an image on a print medium having an edge and includes steps a) through d). Step a) includes obtaining an inkjet printer having a page-wide printhead including a plurality of nozzles disposed to print the image by printing rows of dots as the print medium relatively moves with respect to the printhead along a print swath axis, wherein each row of dots is substantially perpendicular to the print swath axis. Step b) includes disposing the print medium with the edge substantially perpendicular or parallel to the print swath axis. Step c) includes using the printhead to print on the print medium, beyond a preselected distance from the edge, rows of dots representing a portion of the image at a first percent of print swath density. Step d) includes using the printhead to print on the print medium, at and within the preselected distance from the edge, rows of dots representing a portion of the image at a varying percent of print swath density, wherein the varying percent is the first percent at the preselected distance from the edge, wherein the varying percent steps down and not up a plurality of times as the distance from the edge to the dots to be printed decreases.

An overall method of the invention is for printing an image on a print medium having an edge or an edge portion and includes steps a) through c). Step a) includes obtaining a printer adapted to print the image by printing dots. Step b) includes using the printer to print on the print medium, beyond a preselected distance from the edge or edge portion, dots representing a portion of the image at a first percent of print dot density. Step c) includes using the printer to print on the print medium, at and within the preselected distance from the edge or edge portion, dots representing a portion of the image at a varying percent of print swath density, wherein the varying percent is the first percent at the preselected distance from the edge or edge portion, and wherein the varying percent steps down and not up a plurality of times as the distance from the edge or edge portion to the dots to be printed decreases. In one example of the overall method of the invention, the printer is an inkjet printer. Other examples of printers which are adapted to print an image by printing dots are left to the artisan.

Several benefits and advantages are derived from one or more of the methods of the invention. By stepping down the print swath density at least two times as the dots to be printed approach the edge of the print medium allows for borderless printing to that edge in a gradual manner resulting in a more pleasing printed image. By having the varying percent step down by turning off or on more of the address lines in the printhead, by ramping down the voltage to the printhead, or by reducing the printhead power line pulse widths avoids using a masking pattern (requiring special software swath formatting) to achieve a reduced print swath density at the edge to reduce print overspray and gutter ink buildup. In the foregoing, ramping down the print swath density is associated with lowering printhead voltage turning off address lines or decrease power is pulse widths and ramping up print swath density is associated with increasing printhead voltage, turning on more address lines or increasing power pulse. The converse to those actions (e.g., ramping down print swath density by increasing power pulse width, etc.) may also apply. The method of controlling the state of the address lines, the width of the power pulses and the printhead voltage is done to achieve the desired decrease in print swath density as printing moves to the edge of the medium. The method is dependent upon the design of the printhead and the logic used for its control and operation.

The foregoing description of several methods of the invention has been presented for purposes of illustration. It is not intended to be exhaustive or to limit the invention to the precise procedures and forms disclosed, and obviously many modifications and variations are possible in light of the above teaching. It is intended that the scope of the invention be defined by the claims appended hereto.

What is claimed is:

1. A method for printing an image on a print medium having an edge comprising the steps of:

a) obtaining an inkjet printer having a printhead movable along a print swath axis and including a plurality of inkjet nozzles disposed to print the image by printing columns of dots as the printhead moves along the print swath axis, wherein each column of dots is substantially perpendicular to the print swath axis;

b) disposing the print medium with the edge substantially perpendicular or parallel to the print swath axis;

c) using the printhead to print on the print medium, beyond a preselected distance from the edge, columns of dots representing a portion of the image at a first percent of print swath density; and d) using the printhead to print on the print medium, at and within the preselected distance from the edge, columns of dots representing a portion of the image at a varying percent of print swath density, wherein the varying percent is the first percent at the preselected distance from the edge, and wherein the varying percent steps down and not up a plurality of times as the distance from the edge to the dots to be printed decreases.

2. The method of claim 1, wherein the first percent is substantially one-hundred percent.

3. The method of claim 1, wherein the varying percent is between and including zero percent and fifteen percent at the edge.

4. The method of claim 3, wherein the varying percent is substantially five percent at the edge.

5. The method of claim 1, wherein the preselected distance is between and including 0.039 inch and 0.125 inch.

6. The method of claim 1, wherein the varying percent steps down at least ten times as the distance from the edge to the dots to be printed decreases.

7. The method of claim 1, wherein the edge is a left or right edge.

8. The method of claim 1, wherein the edge is a top or bottom edge.

9. A method for printing an image on a print medium having an edge comprising the steps of:

a) obtaining an inkjet printer having a printhead movable along a print swath axis and including a plurality of inkjet nozzles disposed to print the image by printing columns of dots as the printhead moves along the print swath axis, wherein each column of dots is substantially perpendicular to the print swath axis;

b) disposing the print medium with the edge substantially perpendicular or parallel to the print swath axis;

c) using the printhead to print on the print medium, beyond a preselected distance from the edge, columns of dots representing a portion of the image at a first percent of print swath density; and d) using the printhead to print on the print medium, at and within the preselected distance from the edge, columns of dots representing a portion of the image at a varying percent of print swath density, wherein the varying percent is the first percent at the preselected distance from the edge, wherein the varying percent steps down and not up a plurality of times as the distance from the edge to the dots to be printed decreases, and wherein the varying percent steps down by way of controlling the state of the address lines in the printhead.

10. The method of claim 9, wherein the edge is a left or right edge, wherein the edge is substantially perpendicular to the print swath axis, wherein the printhead moves from the preselected distance from the edge to the edge during step d), and wherein the varying percent steps down by turning off one or more of the address lines in the printhead.

11. The method of claim 9, wherein the edge is a left or right edge, wherein the edge is substantially perpendicular to the print swath axis, wherein the printhead moves from the edge to the preselected distance from the edge during step d), and wherein the varying percent steps up by turning on one or more of the address lines in the printhead.

12. The method of claim 9, wherein the edge is a top or bottom edge, wherein the edge is substantially parallel to the print swath axis, wherein the printhead, between print swaths during step d), relatively moves with respect to the print medium in a direction substantially perpendicular to the print swath axis from the edge to the preselected distance from the edge, and wherein step d) includes multiple print passes of sub-printhead-height print swaths with the varying percent stepping up by turning on one or more of the address lines in the printhead with increasing distance from the edge.

13. The method of claim 9, wherein the edge is a top or bottom edge, wherein the edge is substantially parallel to the print swath axis, wherein the printhead, between print swaths during step d), relatively moves with respect to the print medium in a direction substantially perpendicular to the print swath axis from the preselected distance from the edge to the edge, and wherein step d) includes multiple print passes of sub-printhead-height print swaths with the varying percent stepping down by turning off one or more of the address lines in the printhead with decreasing distance from the edge.

14. A method for printing an image on a print medium having an edge comprising the steps of:

a) obtaining an inkjet printer having a printhead movable along a print swath axis and including a plurality of inkjet nozzles disposed to print the image by printing columns of dots as the printhead moves along the print swath axis, wherein each column of dots is substantially perpendicular to the print swath axis;

b) disposing the print medium with the edge substantially perpendicular or parallel to the print swath axis;

c) using the printhead to print on the print medium, beyond a preselected distance from the edge, columns of dots representing a portion of the image at a first percent of print swath density; and d) using the printhead to print on the print medium, at and within the preselected distance from the edge, columns of dots representing a portion of the image at a varying percent of print swath density, wherein the varying percent is the first percent at the preselected distance from the edge, wherein the varying percent steps down and not up a plurality of times as the distance from the edge to the dots to be printed decreases, and wherein the varying percent steps down by controlling the voltage to the printhead.

15. The method of claim 14, wherein the edge is a left or right edge.

16. The method of claim 14, wherein the edge is a top or bottom edge, wherein the voltage is stepwise controlled, and wherein step d) includes multiple print passes of sub-printhead-height print swaths.

17. A method for printing an image on a print medium having an edge comprising the steps of:

a) obtaining an inkjet printer having a printhead movable along a print swath axis and including a plurality of inkjet nozzles disposed to print the image by printing columns of dots as the printhead moves along the print swath axis, wherein each column of dots is substantially perpendicular to the print swath axis;

b) disposing the print medium with the edge substantially perpendicular or parallel to the print swath axis;

c) using the printhead to print on the print medium, beyond a preselected distance from the edge, columns of dots representing a portion of the image at a first percent of print swath density; and d) using the printhead to print on the print medium, at and within the preselected distance from the edge, columns of dots representing a portion of the image at a varying percent of print swath density, wherein the varying percent is the first percent at the preselected distance from the edge, wherein the varying percent steps down and not up a plurality of times as the distance from the edge to the dots to be printed decreases, and wherein the varying percent steps down by controlling the printhead power line pulse widths.

18. The method of claim 17, wherein the edge is a left or right edge.

19. The method of claim 17, wherein the edge is a top or bottom edge, and wherein step d) includes multiple print passes of sub-printhead-height print swaths.

20. A method for printing an image on a substantially-circular-shaped print medium having an edge comprising the steps of:

a) obtaining an inkjet printer having a printhead movable along a print swath axis and including a plurality of nozzles disposed to print the image by printing columns of dots as the printhead moves along the print swath axis creating a print swath, wherein each column of dots is substantially perpendicular to the print swath axis;

b) disposing the circular medium such that the print swath axis is substantially aligned with a diameter of the print medium;

c) choosing a print swath height of printable nozzles such that an edge portion which is in line with the print swath is substantially perpendicular to the print swath axis;

d) using the printhead to print on the print medium, beyond a preselected distance from the edge portion, columns of dots at the print swath height representing a portion of the image at a first percent of print swath density;

e) using the printhead to print on the print medium, at and within the preselected distance from the edge portion, columns of dots at the print swath height representing a portion of the image at a varying percent of print swath density, wherein the varying percent is the first percent at the preselected distance from the edge portion, and wherein the varying percent steps down and not up a plurality of times as the distance from the edge portion to the dots to be printed decreases; and f) after steps a) through e), rotating the print medium about it's center a predetermined amount.

21. A method for printing an image on a print medium having an edge comprising the steps of:

a) obtaining an inkjet printer having a page-wide printhead including a plurality of nozzles disposed to print the image by printing rows of dots as the print medium relatively moves with respect to the printhead along a print swath axis, wherein each row of dots is substantially perpendicular to the print swath axis;

b) disposing the print medium with the edge substantially perpendicular or parallel to the print swath axis;

c) using the printhead to print on the print medium, beyond a preselected distance from the edge, rows of dots representing a portion of the image at a first percent of print swath density; and d) using the printhead to print on the print medium, at and within the preselected distance from the edge, rows of dots representing a portion of the image at a varying percent of print swath density, wherein the varying percent is the first percent at the preselected distance from the edge, wherein the varying percent steps down and not up a plurality of times as the distance from the edge to the dots to be printed decreases.

22. A method for printing an image on a print medium having an edge or an edge portion comprising the steps of:

a) obtaining a printer adapted to print the image by printing dots;

b) using the printer to print on the print medium, beyond a preselected distance from the edge or edge portion, dots representing a portion of the image at a first percent of print dot density; and c) using the printer to print on the print medium, at and within the preselected distance from the edge or edge portion, dots representing a portion of the image at a varying percent of print dot density, wherein the varying percent is the first percent at the preselected distance from the edge or edge portion, and wherein the varying percent steps down and not up a plurality of times as the distance from the edge or edge portion to the dots to be printed decreases.

* * * * *